United States Patent [19]

Kohler

[11] Patent Number: 4,863,087

[45] Date of Patent: Sep. 5, 1989

[54] GUIDE APPARATUS FOR ELONGATED FLEXIBLE WEB

[75] Inventor: Herbert B. Kohler, Greentown, Ohio

[73] Assignee: The Kohler Coating Machinery Corporation, Greentown, Ohio

[21] Appl. No.: 229,225

[22] Filed: Aug. 5, 1988

[51] Int. Cl.[4] ..... B65H 23/32

[52] U.S. Cl. ..... 226/197; 226/15; 226/19; 226/196; 226/198

[58] Field of Search ..... 226/196, 197, 198, 15, 226/18, 21

[56] References Cited

U.S. PATENT DOCUMENTS

| | | | |
|---|---|---|---|
| 2,760,773 | 8/1956 | Brodie | 226/197 |
| 3,954,213 | 5/1976 | Anderson | 226/197 |

FOREIGN PATENT DOCUMENTS

| | | | |
|---|---|---|---|
| 0148074 | 12/1984 | European Pat. Off. | 226/197 |
| 0179346 | 10/1984 | Japan | 226/197 |
| 0167553 | 7/1986 | Japan | 226/197 |

*Primary Examiner*—Daniel P. Stodola
*Assistant Examiner*—Phillip S. Han
*Attorney, Agent, or Firm*—Pearne, Gordon, McCoy & Granger

[57] ABSTRACT

A running web adjustable guide apparatus is disclosed in which substantial lateral adjustment of the web can be accomplished without changing the length of the path of the web through the apparatus. With this guide apparatus, distortion or damage to the web is eliminated. Various set-ups are possible with the preferred embodiment so that the direction of the web can be changed as it moves through the apparatus or maintained constant. Further, in some set-ups the web is inverted. In other set-ups, the web is not inverted. Further, the apparatus can be arranged so the components thereof engage both sides of the web or only one side. In all cases, a movable roller extends perpendicular to the path of the web approaching and leaving such roller, and a movable guide bar is provided which also moves in the same direction as the movable roller but through a distance twice as great as the distance of movement of the movable roller. The web paths approaching and leaving the roller are parallel to each other and to the web path leaving the guide bar so that the wrap angle around the guide bar and the wrap angle around the movable roller remains exactly 180 degrees.

15 Claims, 6 Drawing Sheets

GUIDE APPARATUS FOR ELONGATED FLEXIBLE WEB

BACKGROUND OF THE INVENTION

This invention relates generally to a method and apparatus for guiding flexible web material, and more particularly to a novel and improved method and apparatus for accurately positioning a running or moving elongated flexible web.

PRIOR ART

It is common practice to process various web materials in long or continuous lengths. The web material may, for example, be paper, smooth or creped tissue, paper board, plastic film, woven, or nonwoven fabric, fibrous felts, or metal foil. Some or all of these materials may be processed on the same processing equipment at different times, or even together.

The processing operations may include coating, laminating, saturating, calendering, drying, cooling, curing, and other types of web treatment. Such operations are usually performed in a processing line, which consists of a variety of machine elements, each performing a specific function, all having a common drive so that the line operates as a unit.

Some of these operations often cause the web to change shape in a manner which affects its tracking. This is particularly true of operations involving wetting and drying, or heating and cooling.

It is mandatory, therefore, that web guiding means be provided at various locations in the line to assure accurate alignment of the web as it enters a machine element which is to perform a specific function, such as coating, laminating, printing, winding, or cutting. It is often necessary to guide with a degree of accuracy capable of maintaining the position of the web within a few thousandths of an inch, lest material be wasted or the web be broken or torn. It is essential that the guiding mechanism not distort the web or change the tension therein in any manner whatsoever. To this end, adjusting movement of the device must not change the length of the web path in total, or from edge to edge.

It is also essential that the guiding apparatus be able to correct for a substantial change of location of the web, since poorly wound or "slipped" reels coming from a previous process must also be handled without special attention.

It is further essential that automatic control of the device be provided, to maintain the web position within the established limits without operator attention.

Brodie U.S. Pat. No. 2,750,773 discloses a guide apparatus for web material which can operate to adjust the lateral position of the web. However, such apparatus is incapable of providing substantial amounts of lateral adjustment without producing variations in the length of the path of the web between the two lateral edges of the web.

In the guide apparatus illustrated in the Brodie patent, an angle bar is combined with a roller, both of which are movable laterally relative to the exit direction of the web. The angle bar and roller are connected by a lever system so that the angle bar moves through a distance twice as great as the distance that the roller moves. This mechanism provides lateral adjustment which tends to maintain the length of the path of the web substantially constant. However, the structure of the Brodie patent produces movement of both the roller and the angle bar along arcs. Therefore, the apparatus also provides a component of movement of the roller and angle bar in a direction normal to the plane of the web. The existence of such normal component of movement inherently causes a change in the angle of wrap of the web around the roller and the angle bar, which changes the departure angle of the web leaving the bar, resulting in a nonuniform change in the length of the web path and produces a tension along one lateral edge of the web which is greater than the tension on the other edge of the web.

The Brodie apparatus apparently was designed for use on newspaper type printing presses, where the paper is received in straightly wound reels produced on paper machine winders, and the only guiding requirement is that the printing on the paper be within the margin allowance. It can only provide a satisfactory lateral adjustment through very small distances in which the component of movement in a normal direction is insignificant, but it is unsatisfactory for providing substantial adjustments of the lateral position of the web. The Brodie Pat. No. 2,750,733 is incorporated herein by reference to illustrate prior art web guide apparatus for providing lateral adjustment of the position of a running web.

SUMMARY OF THE INVENTION

There are a number of important aspects to the present invention. In accordance with one important aspect of this invention, a novel and improved method and apparatus are provided for laterally adjusting the position of a flexible running web which does not produce any change in the web path length even when substantial lateral adjusment is involved.

In accordance with another aspect of this invention, a novel and improved method and apparatus are provided for laterally adjusting the position of a flexible running web without producing variations in the length of the web path across the width of the web.

In the illustrated embodiments, a roller extending perpendicular to the path of the web travel is combined with an angle bar and the roller and angle bar are coupled so that the adjusting movement of the angle bar is twice the adjusting movement of the roller and is accomplished without any component of movement in a direction normal to the plane of the web. The roller and angle bar are positioned so that the wrap angle of the web around each of them is maintained constant throughout the entire range of adjustment.

In the illustrated embodiments, the two web paths along which the web moves to and from the roller always lie in parallel planes so that the wrap angle around the roller remains a constant 180 degrees in all adjusted positions. Similarly, the two paths along which the web moves to and from the angle bar lie in parallel planes and the wrap angle around the angle bar is also 180 degrees in all adjusted positions.

The roller and angle bar are movable back and forth in the direction parallel to the planes of movement of the paths, and are connected by a drive mechanism which produces an exact 2:1 ratio of movement so that the length of the web path does not change. Further, since the wrap angle around the angle bar remains constant, the angle between the line of movement of the web as it moves to and from the angle bar remains constant.

In one illustrated embodiment, the drive mechanism which controls the movement of the roller and angle bar is a linkage structured to provide a constant ratio of movement, and in another embodiment, the drive mechanism utilizes a rack and pinion structure.

Further, in some illustrated embodiments, the direction of movement of the web approaching and leaving the guide apparatus is not changed, while in other embodiments, the direction of the movement of the web leaving the guide apparatus is at a right angle with respect to the direction of movement as it approaches the guide apparatus.

In some embodiments, the web is inverted, and in other embodiments, the web is guided without inversion. In some embodiments, the apparatus contacts only one face of the web, while in other embodiments, the guide apparatus contacts both faces of the web.

Because the guide apparatus does not change the length of the web path as the lateral position is adjusted, a constant tension is maintained in the web and the apparatus can be used with substantially any type of web without producing any damage or distortion therein.

These and other aspects of this invention are illustrated in the accompanying drawings, and are more fully described in the following specification.

DETAILED DESCRIPTION OF THE DRAWINGS

Figure 1:
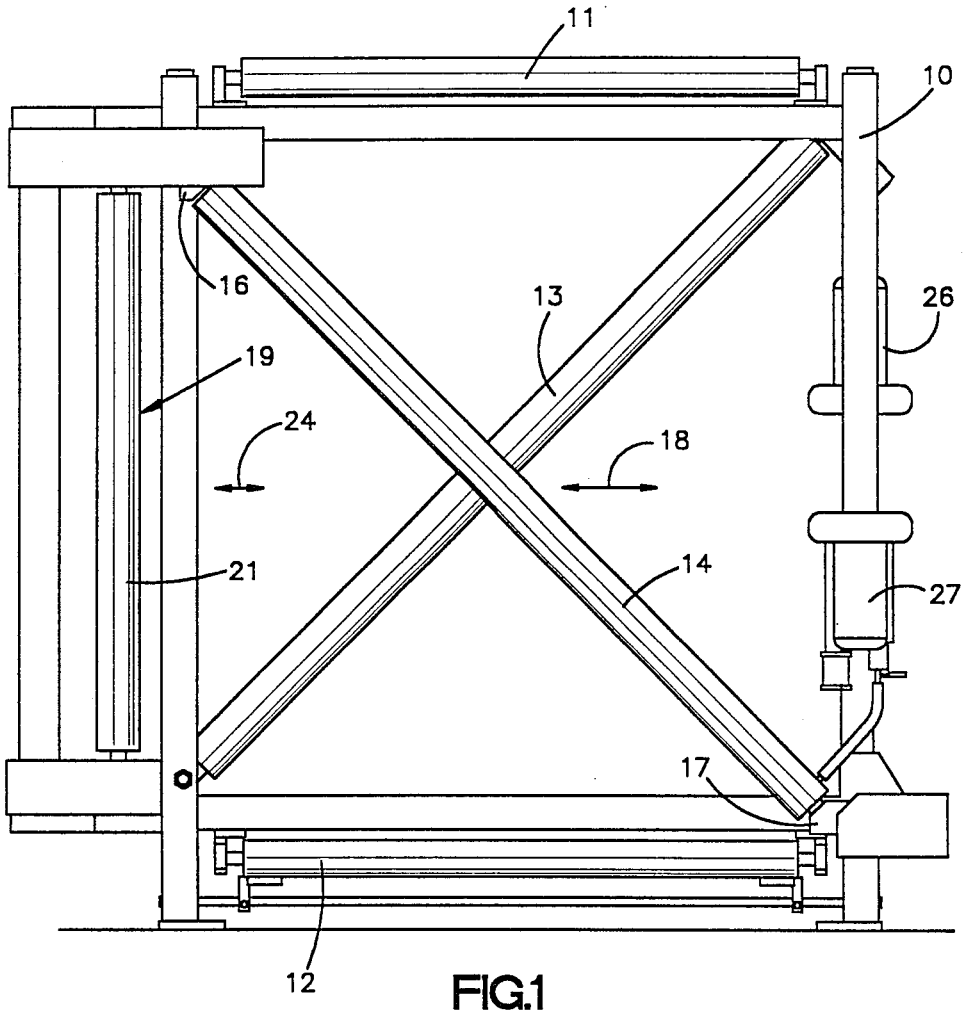
FIG. 1 is a plan view of a preferred embodiment of a guide apparatus incorporating this invention.

FIG. 1 illustrates an overall guide apparatus in accordance with one preferred embodiment of this invention. The apparatus includes a generally rectangular frame 10 which may be mounted in various orientations, but for purposes of this application will be considered to be a horizontally extending frame, even though it could be mounted, for example, in a vertical plane.

Journaled on the frame 10 are fixed rollers 11 and 12 which extend along axes which are parallel to each other. Also mounted on the frame is a fixed guide bar 13 which, in the illustrated embodiment, is angled at 45 degrees with respect to the axes of the rollers 11 and 12.

Also mounted on the frame is a movable guide bar 14 which extends at 45 degrees with respect to the axes of the rollers 11 and 12 and is perpendicular to the fixed guide bar 13. It should be understood that the rollers 11 and 12 and the guide bars 13 and 14 are in different horizontal planes, as discussed in greater detail below.

Figure 2:
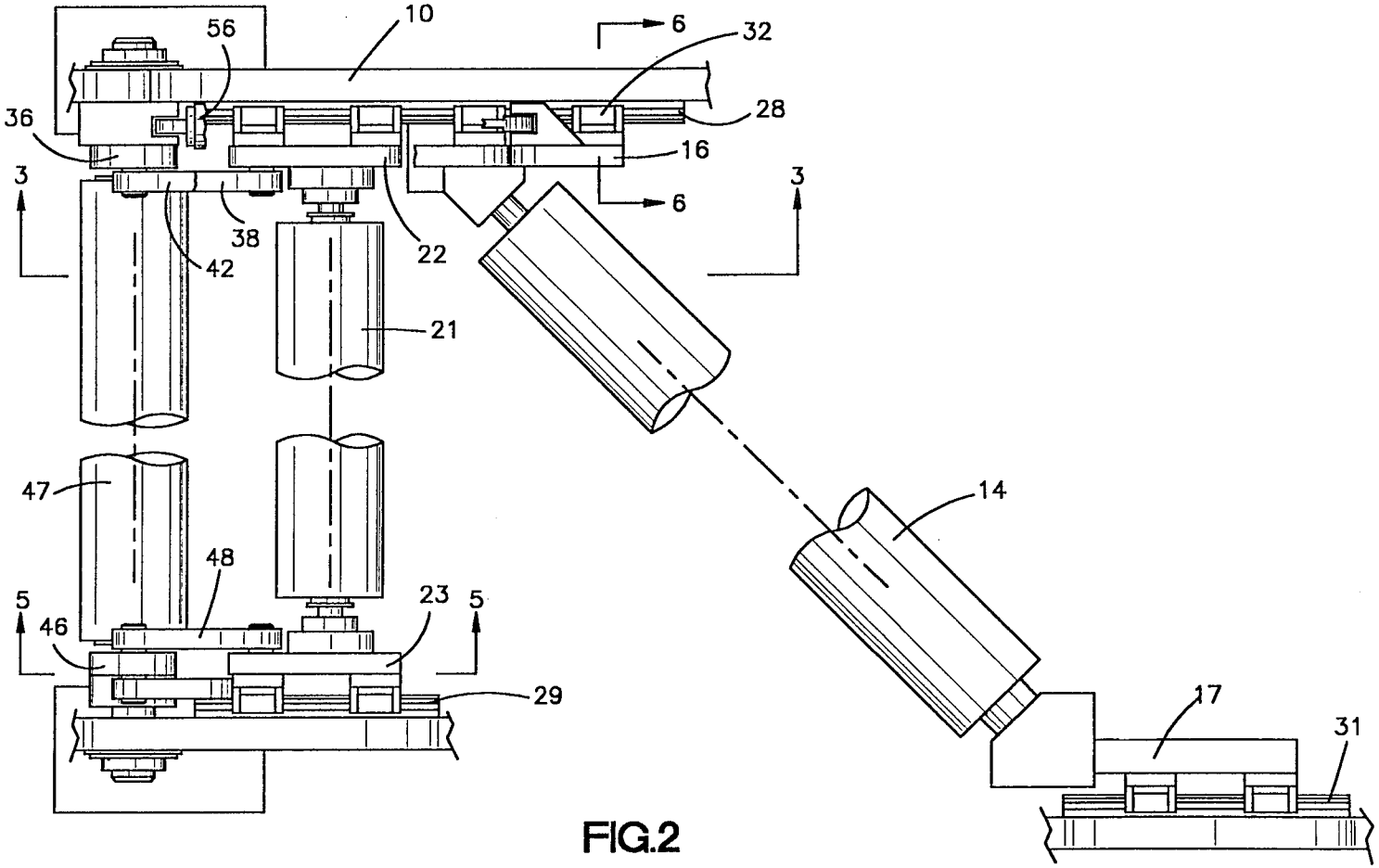
FIG. 2 is a fragmentary plan view of the apparatus illustrated in FIG. 1, with parts removed for purposes of illustration.

The ends of the movable guide bar 14 are mounted on carriage assemblies 16 and 17 for horizontal movement in a direction indicated by the arrow 18 which is parallel to the axes of the rollers 11 and 12. In addition, a movable roller assembly 19 is mounted on the frame 10 and includes at least one movable roller 21 journaled for rotation about an axis at right angles to the axes of the rollers 11 and 12. The movable roller 21 is also mounted at its ends on end carriages 22 and 23, illustrated in FIG. 2, for movement in a direction indicated by the arrow 24 and parallel to the direction of movement of the movable guide bar 14.

The movable roller 21 and the movable guide bar 14 are connected so that the guide bar 14 moves in the direction of the arrow 18 through a distance equal to exactly twice the distance the roller 21 moves in the direction of the arrow 24.

The two guide bars 13 and 14 are respectively provided with fans 26 and 27, which introduce air into the interior of the guide bars for discharge through small drilled holes in the part of the bar covered by the web, so that the guide bars are "air-greased," causing a web extending around the guide bars to float a small distance from the surface of the guide bar so that frictional contact does not exist between the guide bars and a web wrapped therearound.

Figure 6:
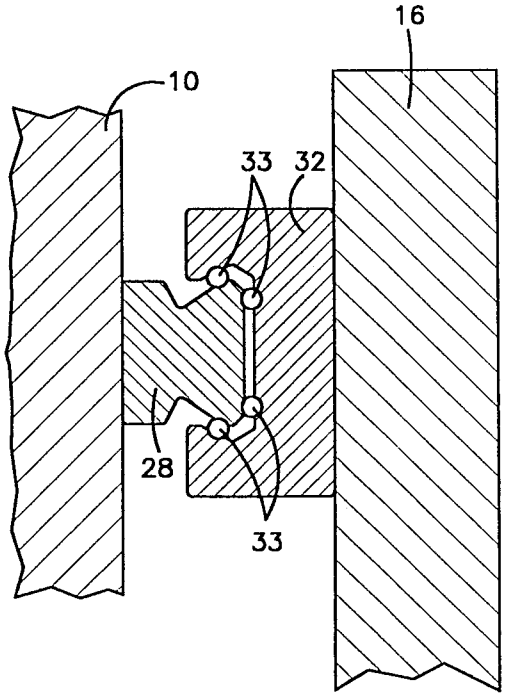
FIG. 6 is an enlarged, fragmentary section taken along line 6—6 of FIG. 2, illustrating one preferred structure for a carriage guide rail.

The carriages 16 and 17 of the movable guide bar 14 and the carriages 22 and 23 of the movable roller 20 are supported for the above-mentioned movement on similar guide rails 28, 29, and 31 mounted on the frame 10 in a parallel relationship. One preferred form of guide rail carriage guiding system is illustrated in FIG. 6. In such guide rail system, the guide rail 28, which is representative of the other guide rails 29 and 31, provides a bearing shoe 32 with antifriction bearings 33 therebetween which support the shoe for longitudinal movement along the guide rail 28. Such structure provides a very accurate linear guide support for the associated carriage and ensures that the movable guide bar 14 and the movable roller assembly 19 both move with straight line movement in exactly the same direction.

Figure 3:
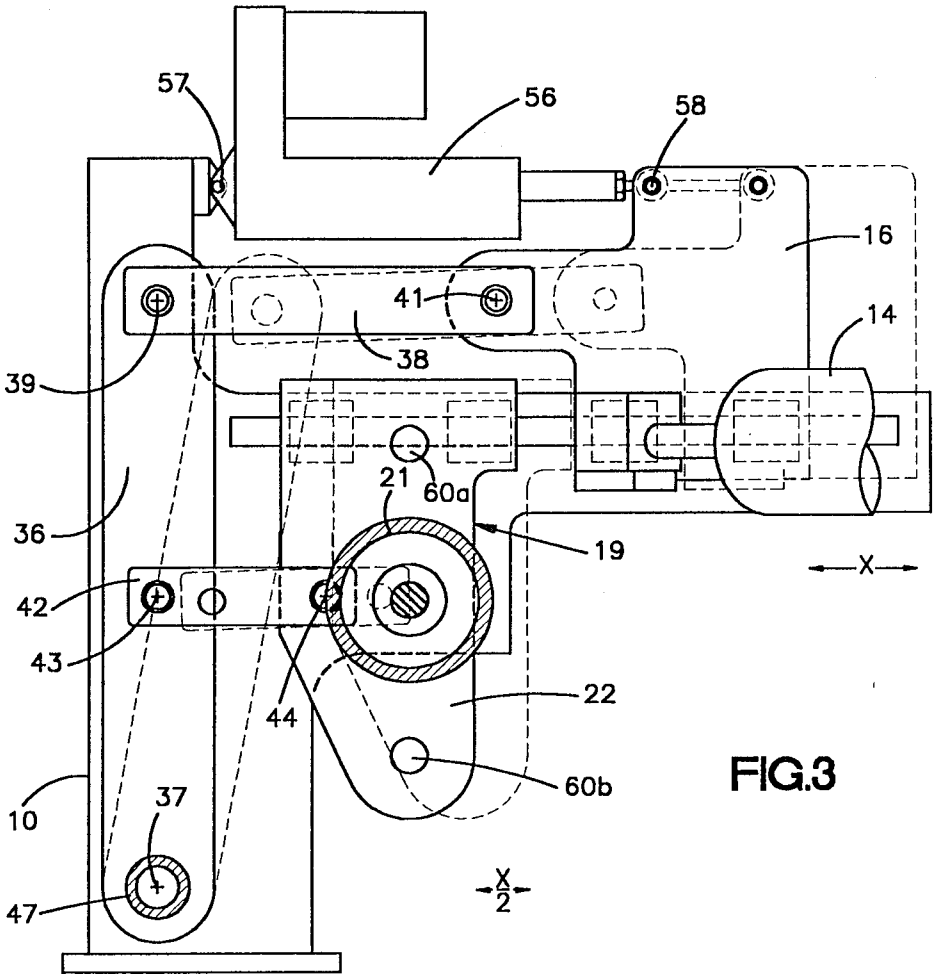
FIG. 3 is a fragmentary side elevation, taken along line 3—3 of FIG. 2, illustrating a linkage operable to interconnect the angle bar carriage and the roller carriage, causing movement of the angle bar carriage through a distance twice as great as the movement of the roller carriage.
Figure 4:
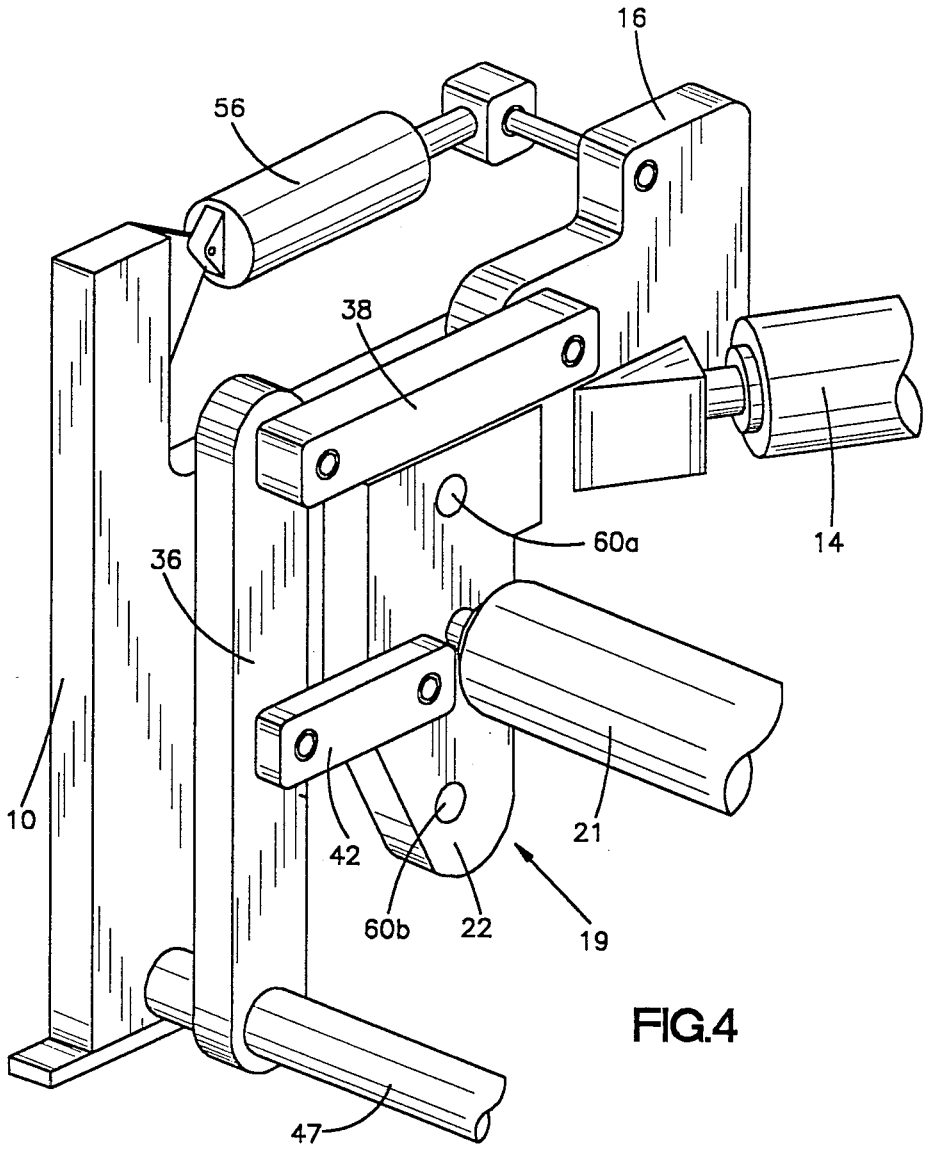
FIG. 4 is a fragmentary, schematic perspective view of the linkage illustrated in FIG. 3.

The linkage for interconnecting the movable roller assembly 19 and the guide bar 14 is best illustrated in FIGS. 3 and 4. Such linkage includes a lever 36 mounted on a torque tube 47, which is in turn pivoted on the frame 10 for oscillating rotation about a pivot axis 37. A first connecting link 38 is pivoted at one end on the lever 36 for pivotal movement about a pivot axis 39 and is pivotally connected at its other end to the carriage 16 for pivotal movement around a pivot axis 41. A second lever 42 is pivoted at one end on the lever 36 for pivotal movement about a pivot axis 43 and is pivotally connected to the carriage 22 for pivotal movement about a pivot axis 44. The pivot axis 39 is spaced from the pivot axis 37 by a distance exactly twice the distance between the pivot axes 37 and 43. Also, the three axes 37, 39, and 43 are in direct alignment. Similarly, the spacing between the pivot axes 39 and 41, respectively, connecting the first link 38 to the lever 36 and carriage 16 is exactly twice as great as the spacing between the pivot axes 43 and 44, respectively, connecting the link 42 to the lever 36 and the carriage 22.

Further, the structure is arranged so that the pivot 41 is spaced from its associated pivot 39 in a direction exactly parallel to the direction the pivot 44 is spaced from the pivot 43. Consequently, the linkage defines two similar triangles. The triangle defined by the pivot axes 37, 39, and 41 is twice as large as the triangle defined by the pivot axes 37, 43, and 44. Therefore, when the carriage 16 moves through a given distance, the carriage 22 moves through exactly one-half the distance of movement of the carriage 16. Further, since both carriages are supported by the same guide bar 28 and must move in the same direction, there is no vertical component of movement between the two carriages. Therefore, as discussed in greater detail below, there is no change in the wrap angle of a web around either the movable guide bar or the movable roller 21.

Figure 5:
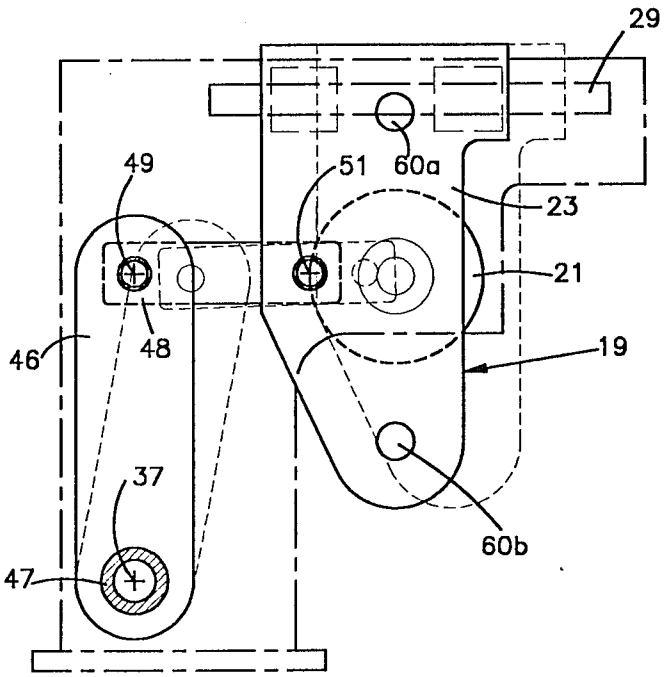
FIG. 5 is a fragmentary side elevation, taken along line 5—5 of FIG. 2, illustrating the linkage located at the opposite end of the roller carriage for ensuring that the two ends of the roller carriage move in unison.

In order to ensure that the end carriages 22 and 23 move through exactly the same distance to ensure that the axis of the roller supported thereon is maintained perpendicular to the direction arrows 24, the lever 36 of the linkage illustrated in FIG. 3 is connected to a lever 46 of a linkage illustrated in FIG. 6 by a torque tube 47. The linkage illustrated in FIG. 5 controls the movement of the carriage 23, which supports the opposite end of the movable roller 21. The lever 46 is also mounted on the torque tube 47 and is in turn journaled for pivotal movement about the axis 37. This lever 46 is connected to the carriage 23 by a third link 48. One end of the link 48 is pivotally connected to the lever 46 for pivotal movement about an axis 49, and the other end of the third link 48 is pivotally connected to the carriage 23 for pivotal movement about an axis 51.

The lever 46 is sized and mounted on the torque tube so that the axes 49 and 43 are coaxial and the lever 48 is sized and mounted so that the axes 44 and 51 are coaxial. Consequently, the three axes 37, 49, and 51 define a triangle which is identical to the triangle defined by the axes 37, 43, and 44. Therefore, when the lever 36 rotates about the pivot axis 37, the lever 46 rotates through a similar distance and causes the carriage 23 to move through exactly the same distance as the carriage 22.

With this linkage arrangement, the movable roller assembly 19 moves with linear straight-line movement in the same direction, and through one-half the distance as the movement of the movable angle bar 14, in spite of the fact that the pivot axes 39, 43, and 49 all move with arcuate movement. In FIG. 3, the relative movement of the levers and links is illustrated in full-line in one position and in phantom in another position. When the carriage 16 moves through a distance x, the carriages 22 and 23 move through one-half the distance, or the distance x/2.

As best illustrated in FIGS. 3 and 4, the power for moving the movable roll carriage assembly 19 and the movable angle bar 14 is supplied by a piston and cylinder actuator 56, which is connected at one end to the frame 10 and at its other end to the movable carriage 16 by pivots 57 and 58, respectively. This actuator is normally connected to an edge sensor, known to persons skilled in the art, which determines the position of the edge of a web exiting the guide apparatus and operates to move the movable guide bar 14 and the roller assembly 19 to establish the desired lateral position of the web leaving the apparatus.

As discussed below, some embodiments utilize one movable roller 21 and other embodiments utilize two movable rollers. The carriages 22 and 23 are provided with two vertically spaced mounting locations **60*a* and 60*b* for mounting the two movable rollers when two movable rollers are required. Further, the frame is provided with multiple locations (not illustrated) for mounting the fixed rollers 11 and 12** so that the vertical position of the fixed rollers can be properly selected for each particular set-up of the apparatus.

Figure 7:
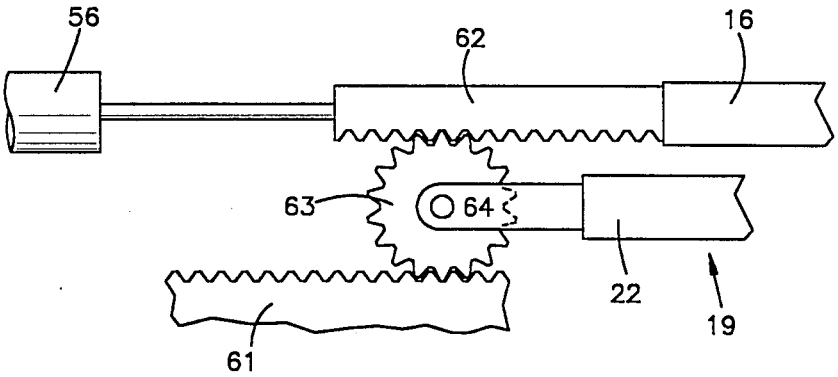
FIG. 7 is a fragmentary, schematic view illustrating a rack and pinion drive to produce movement of the guide bar carriage through a distance twice as great as the movement of the roller bar carriage.

FIG. 7 illustrates a second embodiment of a mechanism which may be substituted for the linkage drive of FIGS. 1 through 5 to produce the 2:1 ratio of movement required. Such apparatus includes a rack and pinion-type drive in which a fixed rack 61 is mounted on the frame of the apparatus and a movable rack 62 is connected to the carriage 16 of the movable angle bar. A pinion gear 63 meshes with both the fixed rack 61 and the movable rack 62, and is pivotally connected by a pivot 64 to the carriage 22 of the movable roller assembly 19. Here again, an actuator 56 is connected to move the carriage 16 back and forth. Because the pinion gear 63 meshes with both the fixed rack 61 and the movable rack 62, the pivot 64 moves through a distance which is exactly one-half the distance of movement of the movable rack 63 so a 2:1 movement ratio is again provided by this structure.

Figure 8:
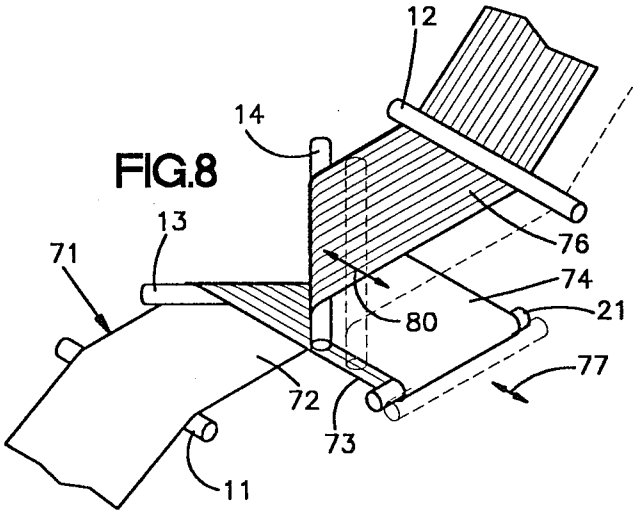
FIG. 8 is a schematic illustration of an embodiment in which the web enters and leaves the apparatus in the same direction, and in which the web is inverted.

FIG. 8 schematically illustrates the operation of a guide apparatus in accordance with this invention in a set-up in which a flexible web 71 enters and leaves the apparatus in substantially the same direction, and in which the web is inverted as it passes through the guide apparatus. In this particular embodiment, the web 71 first passes over the fixed roller 11 and extends along a first web path 72 to the fixed guide bar 13. In an instance in which the apparatus is mounted in a horizontal orientation, the lower extremity of the periphery of the guide bar 13 is horizontally aligned with the upper extremity of the periphery of the roller 11 so that the first web path 72 extends along a first horizontal plane.

The web 71 then wraps around the fixed guide bar 13 through a wrap angle of 180 degrees and passes from the fixed guide bar 13 to the movable roller 21 along a second web path 73 which extends at right angles to the first web path 72. The movable roller 21 is positioned with respect to the fixed guide bar 13 so that the lower extremity of its periphery is horizontally aligned with the upper extremity of the periphery of the fixed guide bar so that the plane of the second web path 73 is parallel to the plane of the first web path 72.

The web 71 is then wrapped around the movable roller 21 through a wrap angle of 180 degrees, and extends back along the apparatus to the movable guide bar 14 along a third web path 74. The upper extremity of the periphery of the movable roller 21 is horizontally aligned with the lower extremity of the periphery of the movable guide bar 14 so that the plane of the web path 74 is parallel to the planes of the web paths 72 and 73.

The web 71 then wraps around the movable guide bar 14 through a wrap angle of 180 degrees and passes from the movable guide bar 14 to a second fixed roller 12 along a fourth web path 76. Here again, the upper extremity of the periphery of the movable guide bar 14 is positioned in horizontal alignment with the lower extremity of the fixed roller 12 so that the web path 76 extends along a plane which is parallel to the planes of the other web paths 72, 73, and 74. From the second fixed roller, the web exits from the apparatus.

In this particular embodiment, the web is inverted as it passes through the guide apparatus so that the lower face of the web (which is shaded in FIG. 8) entering the apparatus is the upper face of the web leaving the apparatus. Further, since the two guide bars 13 and 14 are angulated with respect to the path of the web at an angle of 45 degrees, the web traveling along the web paths 73 and 74 extends at right angles to the direction of the movement of the web along the web paths 71 and 76.

When an edge sensor 75 (known to persons skilled in the art) establishes that lateral adjustment of the web is required, it supplies a signal to the control of the actuator 56 which causes the actuator 56 to move the movable guide bar 14 and the movable roller 21 in a direction indicated by the arrow 77, which is in the same direction as the web movement within the two web paths 73 and 74.

As discussed above, the distance through which the movable guide bar 14 represented by the arrow 80 is moved is twice as great as the distance through which the movable roller 21 moves so that the length of the path of the web through the guide apparatus is not changed. Further, since the movement is in the direction aligned with the planes of the web paths 73 and 74, there is no vertical component of movement, and the wrap angle around the movable roller 21 and the two guide bars 13 and 14 remains exactly 180 degrees. Therefore, the direction of movement of the web along the web path 76 is not changed in any way, even though the web extending along the web path 76 is moved laterally and the lateral adjustment of the web exiting the guide apparatus is therefore accomplished.

Further, since the wrap angle around the two guide bars 13 and 14 remains constant, the direction of movement of the web is maintained constant. If, on the other hand, the apparatus did not maintain a constant wrap angle, the direction of movement of the web leaving the two guide bars would be varied, or the length of the path through the apparatus would vary from one side of the web to the other side. Such a problem, however, does not exist with the present invention, since the wrap angle remains constant in each instance, regardless of the amount of lateral adjustment of the web.

In the set-up of FIG. 8, the fixed roller 11, the movable roller 21, and the fixed roller 12 all engage the surface of the web which originally was on the lower side of the web entering the apparatus, and which is on the upper side of the web leaving the apparatus. In such embodiment, the fixed guide bar 13 and the movable guide bar 14, however, engage the opposite surface of the web, so both surfaces of the web are engaged by various components of the guide apparatus.

Figure 9:
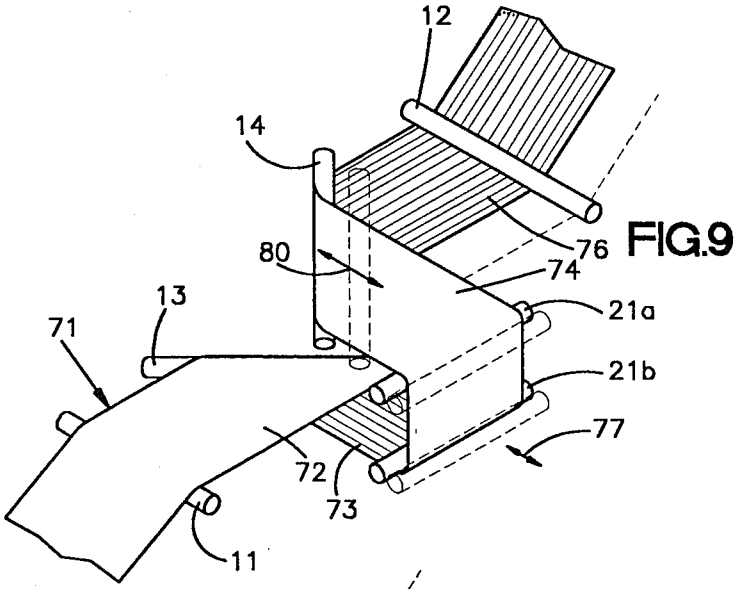
FIG. 9 is a view similar to FIG. 8 illustrating an apparatus in which only one side of the web is engaged by the apparatus.

In some instances, it is necessary to arrange the apparatus so that only a single face of the web is engaged by the apparatus components. Such an arrangement is provided in the set-up of FIG. 9. In this instance, two movable rollers **21*a* and 21*b* are mounted on the movable carriage and the wrap around the two guide bars 13 and 14 is reversed. Therefore, the apparatus is arranged so that the vertical position of the fixed rollers 11 and 12 has been changed within the frame, and so that two rollers can be mounted on the movable roller carriage assemblies 19**.

In this embodiment, the upper extremity of the periphery of the fixed roller is horizontally aligned with the upper extremity of the fixed guide bar 13, and the lower extremity of the periphery of the roller **21*b* is horizontally aligned with the lower extremity of the fixed guide bar 13. Similarly, the upper extremity of the upper movable roller 21*a* is horizontally aligned with the upper extremity of the movable guide bar 14 and the lower extremity of the periphery of the fixed roller 12 is horizontally aligned with the lower extremity of the movable guide bar 14. Therefore, even though the web path 73 is vertically spaced from the web path 74 by a distance greater than in the set-up of FIG. 8, such web paths extend along parallel planes which are parallel to the planes of the web paths 72 and 76. Therefore, the wrap angle around the two guide bars 13 continues to be equal to 180 degrees and movement of the movable guide bar 14 and the movable rollers 21*a* and 21*b* in the direction 77 aligned with the direction of movement along the two web paths 74 operates to adjust the lateral position of the web extending along the web path 76** without changing the length of the path of the web through the apparatus in a manner which is fully uniform across the entire width of the web.

Figure 11:
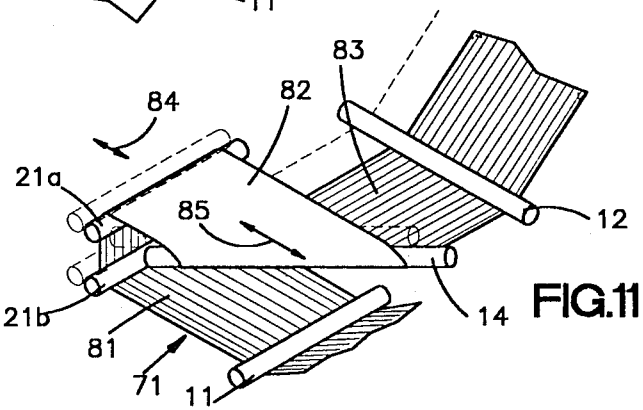
FIG. 11 is a schematic illustration similar to FIG. 10, but illustrating an embodiment in which only one surface of the web is engaged by the apparatus.
Figure 10:
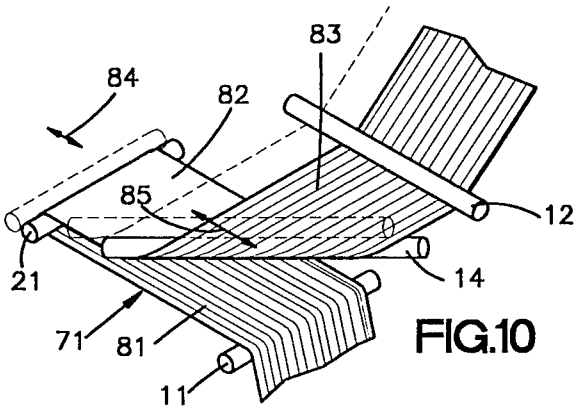
FIG. 10 is a fragmentary, schematic illustration of an embodiment of this invention in which the web is turned at right angles by the apparatus and in which the web is not inverted.

FIGS. 10 and 11 illustrate further set-ups of the operation of an apparatus in accordance with this invention. In these set-ups, the direction of web travel as it leaves the apparatus is at right angles to the direction of web travel entering the apparatus. In this instance, the fixed roller 11 is remounted on the frame in a position in which its axis of rotation is parallel to the axis of rotation of the movable roller 21. In this instance, the web travels along a first web path 81 directly from the fixed roller 11 to the movable roller 21. The upper extremity of the periphery of the fixed roller 11 is horizontally aligned with the lower extremity of the movable roller 21, and the movable guide bar 14 is positioned so that the lower extremity of the movable guide bar 14 is horizontally aligned with the upper extremity of the movable roller 21. Therefore, the plane of the first web path 81 is parallel to the plane of the second web path 82. In this set-up, the lower extremity of the fixed roller 12 is horizontally aligned with the upper extremity of the movable guide bar 14 so that the third web path 83 extending between the movable guide bar 14 and the fixed roller 12 is along a plane parallel to the plane of the web paths 81 and 82.

With such a set-up, the wrap angle around both the movable roller 21 and the movable guide bar 14 remains exactly equal to 180 degrees so that the operation of the apparatus to laterally adjust the position of the web leaving the apparatus does not change the length of the path, nor does it change the length of the path from one side of the web to the other. Here again, when the movable roller 21 and the movable guide bar 14 are moved in a direction indicated by the arrows 84 and 85 which are parallel to the web paths 81 and 82, the position of the web is moved laterally, as indicated in phantom in FIG. 10.

In the set-up of FIG. 10, the fixed roller 11 engages the underside of the web entering the apparatus and the guide bar also engages the same face of the web. However, the movable roller 21 and the fixed roller 12 engage the opposite side of the web.

FIG. 11 illustrates a variation of the set-up of FIG. 10, in which all of the guide apparatus components engage the same side of the web 71. In this embodiment, the fixed roller 11 is positioned so that its lower peripheral extremity is horizontally aligned with the lower extremity of the periphery of a first movable roller 21*b* so that the web path 81 again moves along a horizontal plane. However, two movable rollers 21*a* and 21*b* are provided so that a greater vertical spacing is provided between the two web paths 81 and 82.

The upper extremity of the periphery of the upper movable roller 21*a* is horizontally aligned with the upper extremity of the periphery of the movable guide bar 14 so that the web path 82 extends along a plane parallel to the plane of the web path 81. Similarly, the fixed roller 12 is positioned so that its lower peripheral extremity is horizontally aligned with the lower peripheral extremity of the movable guide bar 14 so that the third web path 83 extends along a horizontal plane parallel to the planes of the web paths 81 and 82. Consequently, the wrap angle around the movable guide bar 14 remains at 180 degrees, and movement of the movable guide bar 14 and the movable rollers 21*a* and 21*b* in the directions 84 and 85 parallel with the planes of the web paths does not change the wrap angle. In this instance, however, all of the guide apparatus components engage the same side of the web, which in this illustrated embodiment is the upper side of the web entering and leaving the apparatus.

In all of the above set-ups the first and second web paths of the web approaching and leaving the movable rollers move in opposite directions along spaced parallel planes and the third web path leaving the movable angle bar extends at right angles to the directions of movement of the first and second web paths along a plane parallel to the planes of the first and second web paths. During the adjustment of the lateral position of the third web path, the total length of the second and third web paths remains constant. For example, if the length of the first web path is reduced, the length of the second web path is increased the same amount. Conversely, when the length of the first web path is increased the length of the second web path is decreased the same amount. Further, since the wrap angle around the angle bar remains exactly 180 degrees, the third web path continues to extend at an exact right angle. Therefore, the total length of the web paths remains constant across the entire width of the web.

With this invention, a simple, reliable guide apparatus is provided in which substantial ranges of lateral adjustment of a running web can be achieved without any change in the length of the path of the web through the apparatus, and in which the lateral adjustment can be accomplished without any variation in the length of the path from one side of the web to the other. Further, a simple mechanical connection is provided to ensure that the movable rollers move to a distance exactly equal to one-half the distance of movement of the movable guide bar. Such mechanical drive is reliable and economical to produce.

Further, with the present invention, appropriate vertical positioning of the various rollers and guide bars in the apparatus permits the use of the apparatus in a large variety of set-ups so that the apparatus can be used in any one of a large variety of installations.

Although the preferred embodiments of this invention have been shown and described, it should be understood that various modifications and rearrangements of the parts may be resorted to without departing from the scope of the invention as disclosed and claimed herein.

What is claimed is:

1. An angle bar apparatus for laterally adjusting the position of an elongated flexible web comprising a frame, roller means mounted on said frame, angle bar means mounted on said frame, said web extending:

(a) relative to said roller means along a first path contained in a first plane;

(b) between said roller means and said angle bar along a second path parallel to said first path and contained in a second plane parallel to said first plane; and (c) relative to said angle bar along a third path contained in a plane parallel to said first and second planes and extending in a direction angled with respect to said first and second paths;

said roller means and said angle bar means being movable relative to said frame back and forth only in a direction parallel to said first and second paths, and connecting means moving said angle bar means through a distance of movement twice as great as the distance of movement of said roller means, said first guide means supporting said roller means on said frame for movement in a predetermined direction parallel to the direction of said first and second paths, and said second guide means supporting said guide bar for movement in said predetermined direction.

2. An apparatus as set forth in claim 1, wherein said roller means includes only one roller.

3. An apparatus as set forth in claim 2, wherein said roller means includes two rollers journaled for rotation about parallel axes, and said first and second paths are spaced apart a distance greater than the diameter of either of said rollers.

4. An apparatus as set forth in claim 1, wherein said connecting means includes a linkage defining similar triangles, with the triangle associated with said guide bar being twice the size of the triangle associated with said roller means.

5. An apparatus as set forth in claim 1, wherein said connecting means includes a rack and pinion drive providing a fixed rack, a pinion engaging said fixed rack and connected to position said roller means, and a movable rack engaging said pinion on the side thereof opposite said fixed rack connected to position said guide bar.

6. An apparatus as set forth in claim 1, wherein said guide bar extends at an angle of 45 degrees relative to said roller means, and said third path extends at right angles with respect to said second path.

7. An apparatus as set forth in claim 1, wherein said web provides opposed first and second faces, said roller means being positioned against said first face, and said guide bar being positioned against said second face.

8. An apparatus as set forth in claim 1, wherein said web provides opposed first and second faces, said roller means and guide bar being positioned against said first face.

9. An apparatus as set forth in claim 1, wherein said apparatus includes a fixed guide bar and said first path extends between said fixed guide bar and said roller means.

10. An apparatus as set forth in claim 9, wherein said apparatus provides a first fixed roller cooperating with said roller means to establish the wrap angle of said web around said fixed guide bar, and second fixed roller cooperating with said movable guide bar to establish said plane of said third path.

11. An angle bar apparatus for running web material, comprising a frame, a roller carriage mounted on said frame for movement in a predetermined straight-line direction, an angle bar carriage mounted on said frame for movement in said predetermined straight-line direction, elongated movable roller means journaled on said roller carriage and extending perpendicular to said predetermined straight-line direction, elongated movable guide bar means mounted on said guide bar carriage angulated with respect to said predetermined straight-line direction, and power means operating to move said roller carriage and said guide bar carriage in said predetermined straight-line direction with the movement of said guide bar carriage twice the movement of said roller carriage.

12. An apparatus as set forth in claim 11, wherein said roller carriage provides a plurality of positions for mounting said roller means.

13. An apparatus as set forth in claim 12, wherein a first member mounted on said frame cooperates with said movable guide bar to establish the wrap angle of said web around said roller means, and a second fixed member mounted on said frame cooperates with said movable roller means to establish the wrap angle of said web around said movable guide bar.

14. An apparatus as set forth in claim 13, wherein said first member is a fixed guide bar positioned at an angle with respect to said roller means.

15. An angle bar apparatus for laterally adjusting the position of an elongated flexible running web comprising a frame, first and second glide members mounted on said frame, said web extending:

(a) along a first path to said first member along a first plane;

(b) along said first member through a 180-degree wrap angle;

(c) along a second path between said first and second members along a second plane parallel to said first plane;

(d) around said second member through a 180-degree wrap angle; and (e) along a third path from said second member along a third plane parallel to said first and second planes, one of said members being a roller extending perpendicular to the adjacent of said paths, the other of said members being an elongated angle bar positioned at an angle relative to the adjacent of said paths, said members both being mounted on said frame for motion back and forth only in a predetermined direction parallel to said paths adjacent to said roller, and means interconnecting said member causing said angle bar to move in said predetermined direction through a distance equal to twice the distance of movement of said roller, movement of said members in said predetermined direction occurring without any change in the wrap angle of said web around said members.

* * * * *